US005363640A

United States Patent [19]

Schick

[11] Patent Number: 5,363,640

[45] Date of Patent: Nov. 15, 1994

[54] BRACELET, PARTICULARLY WATCH BRACELET

[75] Inventor: Herve Schick, Besancon, France

[73] Assignee: Complications S.A., La Cote-Aux-Fees, Switzerland

[21] Appl. No.: 7,266

[22] Filed: Jan. 21, 1993

[30] Foreign Application Priority Data

Jan. 21, 1992 [CH] Switzerland ..... 157/92

[51] Int. Cl.[5] ..... A44C 11/00

[52] U.S. Cl. ..... 59/80; 63/4

[58] Field of Search ..... 59/80, 82, 78; 63/4

[56] References Cited

FOREIGN PATENT DOCUMENTS

| | | | |
|---|---|---|---|
| 0118774 | 9/1984 | European Pat. Off. . | |
| 0653224 | 12/1985 | Switzerland | 59/82 |
| 0657026 | 8/1986 | Switzerland | 59/82 |
| 659571 | 2/1987 | Switzerland . | |
| 664267 | 2/1988 | Switzerland . | |
| 664475 | 3/1988 | Switzerland . | |
| 331155 | 6/1930 | United Kingdom . | |
| 1246865 | 9/1971 | United Kingdom . | |
| 8912758 | 12/1989 | WIPO | 63/4 |

*Primary Examiner*—David Jones

*Attorney, Agent, or Firm*—Young & Thompson

[57] ABSTRACT

An armband is formed by the succession of central elements 3, intermediate elements 2 and lateral elements 1. Each central element 3 include at each of its ends two fixing pins 13, crossing distinct intermediate elements 2. The ends of these fixing pins 13 are located on the same side of the central element 3, being axially retained into the outside element 1 by rider 19 which authorises a relative rotation of these fixing pins 13 with respect to the outside elements 1.

5 Claims, 4 Drawing Sheets

BRACELET, PARTICULARLY WATCH BRACELET

BACKGROUND OF THE INVENTION

The present invention has for its object an armband for a watch constituted by a succession of members hinged one to the other. There are numerous armbands of this type generally comprising a certain number of elements which are removable in order to permit the adjustment of the length of the watchstrap on wrist of the user.

These armbands are generally intended to equip a given type of watch case for which they are particularly intended due to their shape and their ornament. Now for a same type of watch case, there exist several variants, embodiments made of gold, made of silver, and or in colors, with or without diamonds or precious stones. For each of these variants, it is desirable to have a particular variant of the watchstrap in order that the ornamentation of the watch and armband constitute a unity. This necessitates one to dispose of an important number of types of armbands and does not permit the buyer to personalize his watch since the armlet variants, which correspond to the variants of the casing, are decided by the manufacturer.

SUMMARY OF THE INVENTION

The present invention has for its object to reduce the number of armband variants which have to be stored, still permitting one to realize a greater number of variations according to the desire of the buyer, by the assembling of standard elements in different configurations.

This result is obtained by the armband or a watchstrap according to the invention.

BRIEF DESCRIPTION OF THE DRAWINGS

The attached drawing shows partially and schematically and by way of example two embodiments of the armband according to the invention.

DETAILED DISCLOSURE OF THE PREFERRED EMBODIMENTS

The armband of the invention comprises central elements, intermediate elements and outside elements. The intermediate elements and the outside elements are all standards, identical, whereas the central elements can be either metallic or may comprise a stone as a principal ornamental element. The armband is designed so that all the elements can be removable and particularly in order that the central elements, metallic or comprising a stone, can be interchangeable according to the desire of the buyer in order to modify the appearance of the armband while using only standard elements which are removable and interchangeable.

The armband comprises of course end elements intended to be connected either to the casing of a watch or to a band closing device. These elements will not be described here since they are not the object of the invention.

Figure 1:
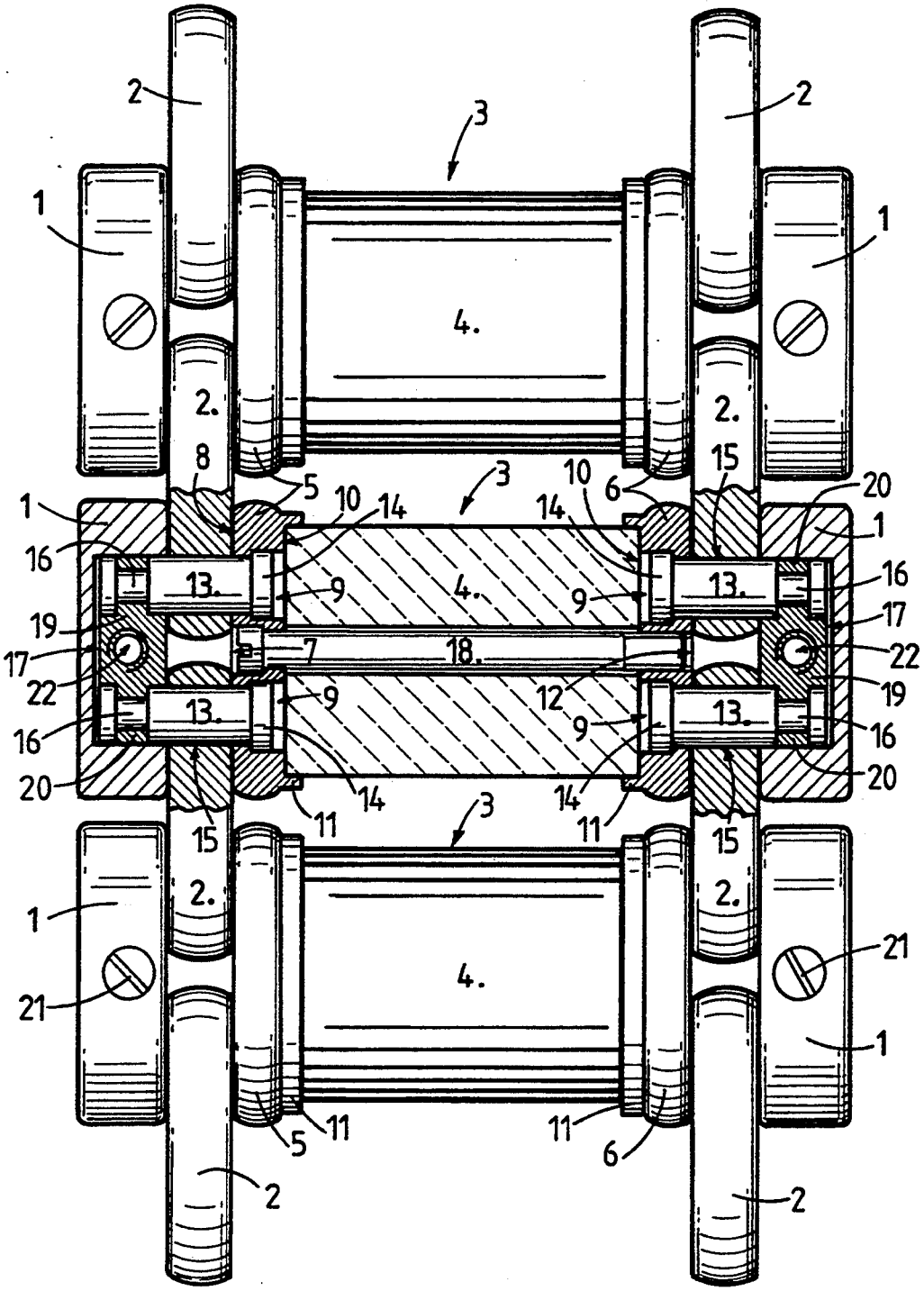
FIG. 1 and 2 show each the succession of three elements of the armband, the embodiment of FIG. 1 comprising stone elements and the embodiment of FIG. 2 metallic elements, all these elements being interchangeable and removable.

In reference to FIG. 1, the armband comprises outside elements 1, intermediate elements 2 and central elements 3, the principal ornamental element of which is constituted by a cylinder like body 4 made out of precious stones or semi-precious stones.

Each central element 3 comprises the cylindrical body 4 in stones, pierced through by an axial hole, and two metallic flanges 5, 6. The flanges 5 have three holes pierced throughout, a central hole 7, presenting a housing of greater diameter merging out on its outside face 8 and two lateral holes 9 presenting each a housing of greater diameter merging on an internal face 10. This internal face 10 has a rim 11 coming into a service position around one of the ends of the cylindrical body 4.

The flange 6 of each central element 3 comprises, as the flanges 5, holes 9 and the rim 11, but the central hole 7 is replaced by a threading 12.

In a service assembled position, the body 4 is tightened between the two flanges 5,6 which are maintained by means of a screw 18, the head of which abuts against the shoulder of the hole 7 of the flange 5. The threaded end of the screw 18 is screwed into the threading 12 of the flange 6.

Figure 7:
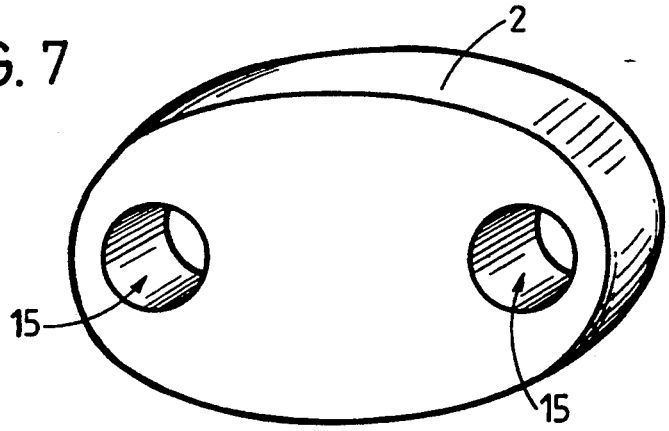
FIG. 7 shows in perspective view an intermediate element.
Figure 8:
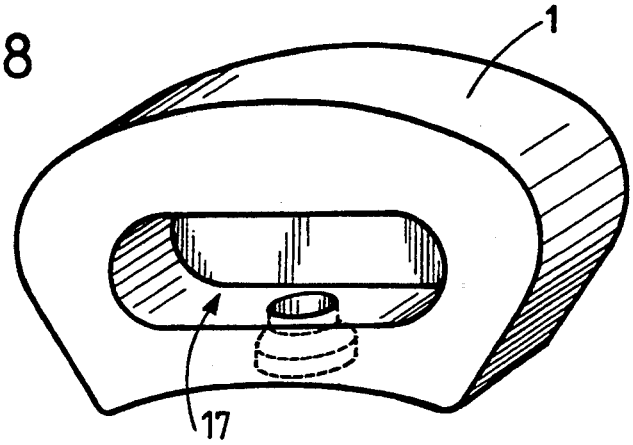
FIGS. 8 to 10 show an outside element and its rider seen from the side and from underneath.
Figure 9:
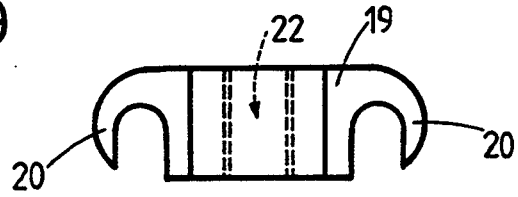
Figure 10:
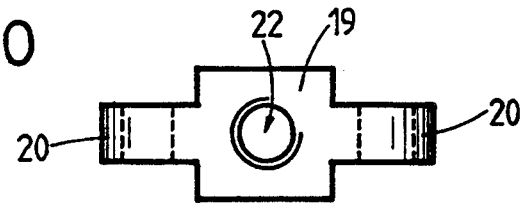

The assembly constituted by the body 4, the flanges 5,6 and the screw 18 constitute the central element 3. Such a central element 3 is connected at each of its ends to two neighbouring intermediate elements 2 by means of fixing pins 13. Each pin 13 comprises a cylindrical head 14 secured in a housing of greater diameter inside the hole 9 of each flange 5,6. The pin 13 crosses the flange 5,6, crosses also the intermediate element 2 through a hole 15 (FIG. 7), and comprises near its other end, a groove defining a portion of a smaller diameter 16 of this pin 13.

The ends comprising the portion of smaller diameter 16 of the two adjacent pins 13, pivoted into the same flange 5,6 are engaged in a dead recess 17 provided in the outside element 1. A rider 19 connects the two adjacent pins 13 by means of beaks 20 which are introduced into the groove of these pins 13. This rider 19 is, in the service position, also disposed into the dead recess 17 of the outside element 1 and is maintained in this position by means of a fastening screw 21 extending crosswise through the wall of the outside element 1 and being screwed into a threading 22 of the rider 19.

The armband or watchstrap thus realized is very supple and each element 1,2,3 is removable and interchangeable. This is very interesting for particularly the central element, 3, the body 4 of which can be replaced by another one, provided with a stone presenting another colour or another texture, at the request of the buyer who is permitted thus to personalize the armband or watchstrip.

Figure 2:
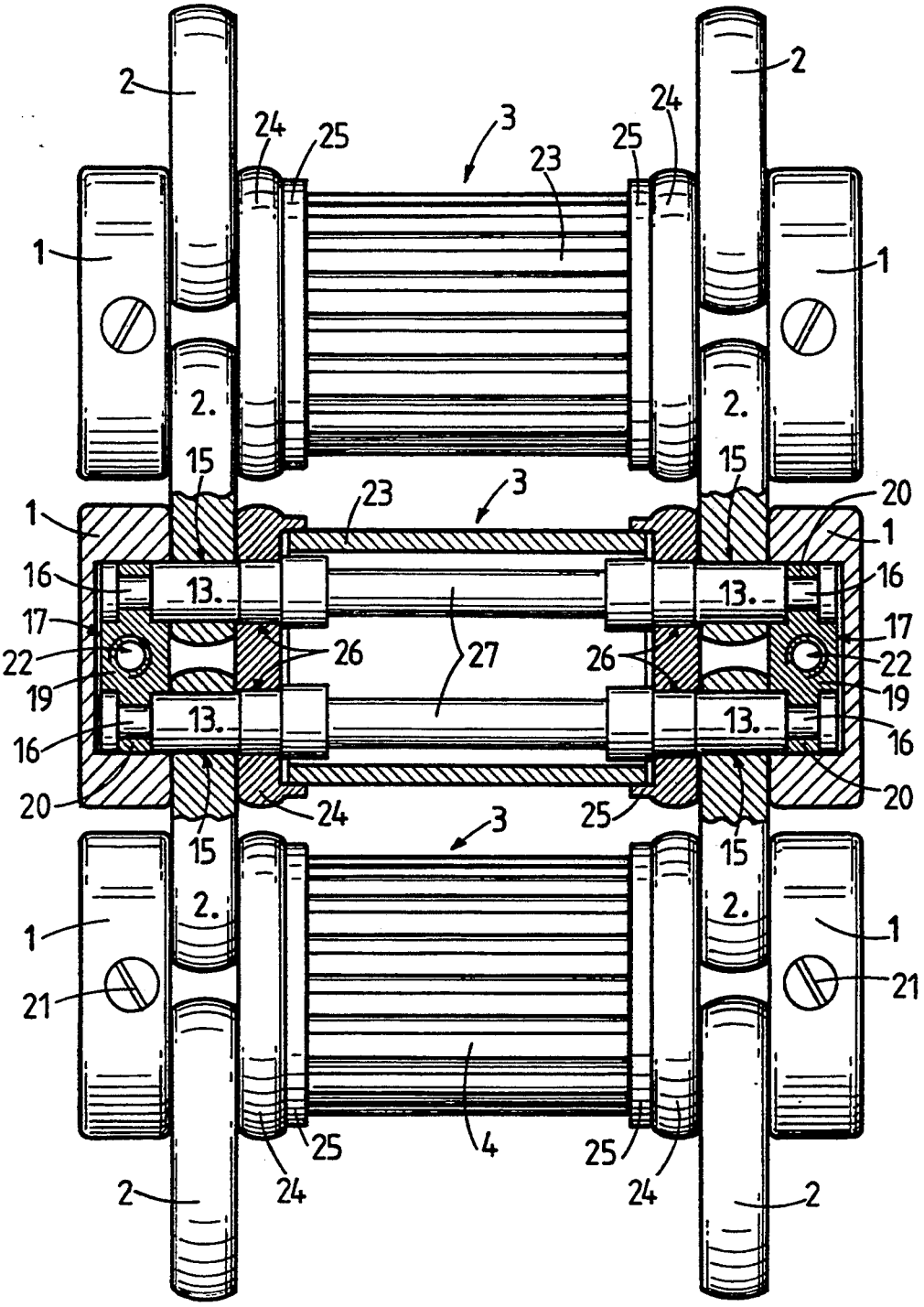
Figure 3:
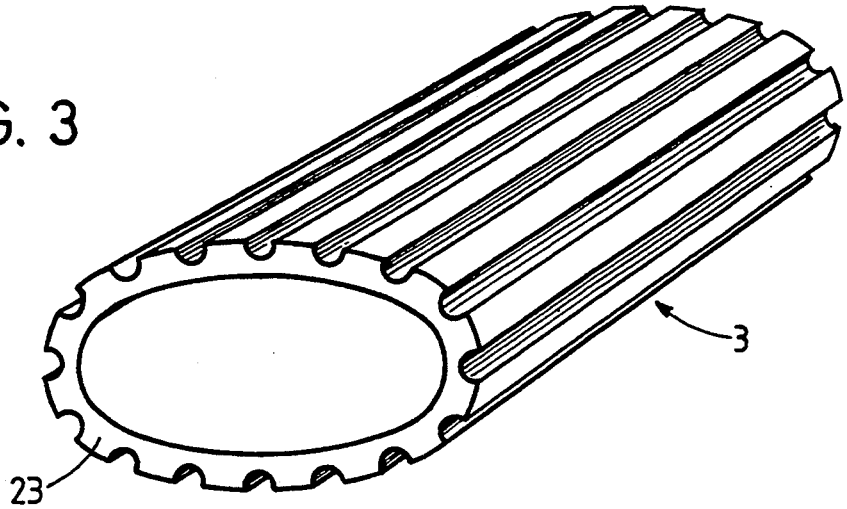
FIG. 3 shows the metallic body of a central element of the armband.
Figure 4:
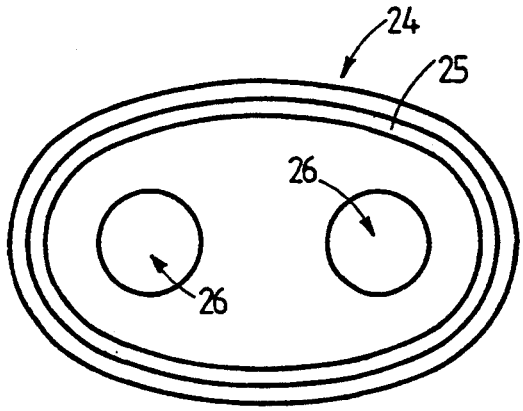
FIG. 4 shows a flange for the central element cooperating with the body of the central metallic element of FIGS. 2 and 3.
Figure 5:
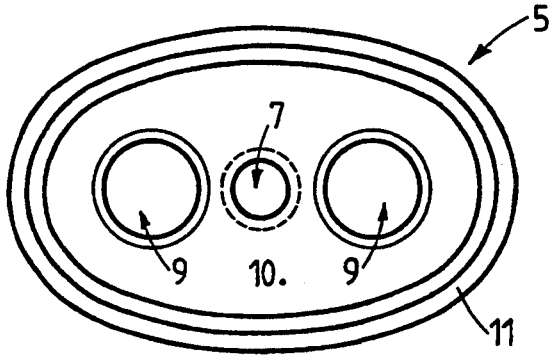
FIGS. 5 and 6 show two flanges for central elements cooperating with a body of the central elements made in stone for the armband shown at FIG. 1.
Figure 6:
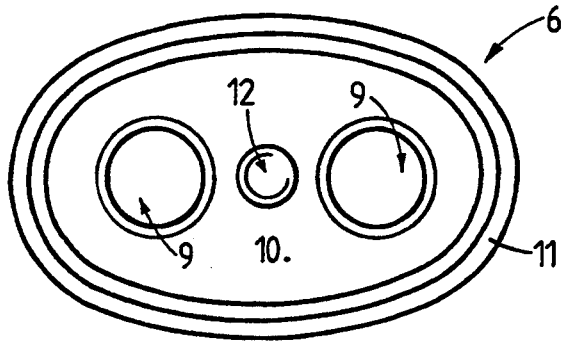

In the embodiment of the armband shown at FIG. 2, comprising central elements 3 made of metal, the armband comprises the same intermediate elements 2 and outside elements 1, as described in the first embodiment of FIG. 1.

Here the central element 3 comprises a metallic tubular body 23, the outside surface of which is provided with ribs and grooves, but which could present another finish or another ornament. This tubular body 23 is closed at its ends by means of flanges 24 presenting a rim 25 surrounding the corresponding end of the body 23. Each flange 24 comprises two holes 26.

In this embodiment the armband comprises further axial shafts 27, the ends of which are made the same as the ones of the pins 13 and are maintained in an identical manner in the dead recess 17 of the outside element 1 by means of the rider 19 and the screw 21.

Two axial shafts 27, fixed to the same outside element 1, cross two intermediate elements 2 which are adjacent one to the other, cross through the hole 15 through the central element 3, through the holes 26 of the flanges 24, and through the inside of the tubular body 23.

In this embodiment also each element 1,2,3 is removable and each central element 3 can be exchanged without all the armband having to be dismantled. One may also, by offering several tubular bodies 23 of different aspects, personalize the armband to the request of the client and change it, element by element, to obtain the desired outlook without disassembling the whole armband.

Because the ends of the shafts 27 are made in an identical manner as the ends of the pins 13, one may also replace the central element 3 made of metal (FIG. 2) by another central element 3 comprising the body 4 made out of stone and realize thus a composite armband comprising stones and metal elements which have never been proposed up to now.

The main interest of this new armband or watchstrap resides in its conception which enables one to replace an element, particularly the central element 3 by another one without dismantling the whole armband and also to enable one to interchange at will metallic central elements with central elements having a body made out of stones or another material.

It is evident that in a variant these metallic central elements 3 could be provided with a tubular body 23, flanges 5,6 and pins 13, the whole being maintained in an assembled condition by the screw 18.

This solution comprising more metallic pieces is optional for a central tubular metallic element. It is however necessary in the case of the central element 3 having the body 4 made in stone, since this stone can not be pierced through two longitudinal holes which would render it too fragile.

Thus, the present armband distinguishes itself essentially in that it comprises central elements 3 provided on each of its sides with two lateral linkage members crossing each the intermediate element 2 and fastened axially but not in rotation with an outside element 1. Thus, each central element of the armband can be removable and interchangeable without dismantling the whole armband. Different types of central elements 3, metallic ones or ones comprising the body 4 made out of stone, can be foreseen to personalize at the demand of a customer a given armband.

It is evident that the ends of the armband could comprise a smaller width. In this case the central elements 3, at the end of the armband would have progressively decreasing lengths so as to reduce progressively the width of the armband. Also the ends of the armband are provided with elements which are adapted to be connected to the watchcase or to a closing device.

In certain embodiments, joints can be interposed between the flanges 24 and the body 23 of the central elements 3.

It goes without saying that the body of the central elements 3 being tubular or plain can present a circular, oval, elliptic, polygonal or any other shaped cross section.

I claim:

1. A watch armband, comprising:

a succession of central elements, intermediate elements, and outside elements;

fixing pins being arranged at ends of the central elements and crossing through the intermediate elements, said fixing pins also having ends axially retained in the outside elements;

said outside elements having internal faces with dead recesses therein, said dead recesses receiving the ends of the fixing pins;

riders being maintained in the dead recesses and connecting with the ends of the fixing pins; and fasteners maintaining the riders in the dead recesses, said fasteners extending crosswise through the outside elements into the dead recesses.

2. A watch armband according to claim 1, wherein the intermediate elements each have at least two holes through which the fixing pins extend.

3. A watch armband according to claim 1, wherein the central elements include tubular bodies with opposite ends and also include at least two flanges closing the opposite ends of the tubular bodies.

4. A watch armband according to claim 1, wherein the central elements include flanges and cylindrical bodies pierced through by axially extending holes.

5. A watch armband according to claim 4, wherein there are four fixing pins extending out of the ends of the central elements, through the flanges, and into the outside elements.

* * * * *